US005985044A

United States Patent [19]

Kurita et al.

[11] Patent Number: 5,985,044

[45] Date of Patent: Nov. 16, 1999

[54] FORGED, NON-HEAT TREATED, NITRIDED STEEL PARTS AND PROCESS OF MAKING

[75] Inventors: Masato Kurita, Takarazuka; Harunori Kakimi, Sakai, both of Japan

[73] Assignee: Sumitomo Metal Industries, Ltd., Osaka, Japan

[21] Appl. No.: 08/886,538

[22] Filed: Jul. 1, 1997

[51] Int. Cl.[6] ..... C21D 1/06; C23C 8/20; C23C 8/50

[52] U.S. Cl. ..... 148/226; 148/318

[58] Field of Search ..... 148/226, 230, 148/318; 420/128, 104

[56] References Cited

U.S. PATENT DOCUMENTS

| | | | |
|---|---|---|---|
| 3,259,487 | 7/1966 | Mueller et al. | 420/128 |
| 4,279,646 | 7/1981 | Kato et al. | 420/83 |
| 4,784,922 | 11/1988 | Yoshimura | 420/128 |

FOREIGN PATENT DOCUMENTS

| | | | |
|---|---|---|---|
| 59-16949 | 1/1984 | Japan | 148/318 |
| 64-68424 | 3/1989 | Japan . | |
| 4-193931 | 7/1992 | Japan . | |

*Primary Examiner*—Deborah Yee

*Attorney, Agent, or Firm*—Burns, Doane, Swecker & Mathis, LLP

[57] ABSTRACT

Forged, nitrided steel parts having a high fatigue limit and bending toughness are produced without heat treatment for refining between the forging and nitriding. The steel has a composition consisting essentially, on a weight basis, of: 0.30–0.60% of C, 0.05–1.50% of Si, 0.20–2.00% of Mn, less than 0.02% of P, less than 0.04% of S, not greater than 0.30% of Cr, less than 0.01% of Al, 0.01–0.02% of N, and a balance of Fe and incidental impurities in which the content of V as an impurity is 0.02% or less. The steel composition may further contain at least one element selected from P: 0.02–0.07%, S: 0.04–0.10%, Ca: 0.0003–0.003%, and Pb: 0.01–0.20% in order to provide it with improved machinability.

20 Claims, 3 Drawing Sheets

δ = amount of thermal distortion

FORGED, NON-HEAT TREATED, NITRIDED STEEL PARTS AND PROCESS OF MAKING

BACKGROUND OF THE INVENTION

The present invention relates to forged steel parts (forgings) produced by hot forging followed by nitriding without heat treatment between the forging and nitriding and having a high fatigue limit and an excellent bending toughness, and to a steel composition suitable for use in the production of such forgings.

Forged steel parts for use in automobiles, such as crankshafts, connecting rods, and knuckles, have conventionally been produced from a carbon steel or an alloy steel by successively subjecting a billet or roughly-shaped dummy of the steel to hot forging to give a shape desired for the part, heat treatment for refining (thermal refining) such as quenching-and-tempering, normalizing, or normalizing-and-tempering, then machining, if necessary, into a finished shape, and finally nitriding, as shown in FIG. 1(*a*). Thus, for forged steel parts required to have good resistance to seizure and galling and improved fatigue limit, thermal refining has been performed prior to final nitriding.

In recent years, however, attempts have been made to eliminate the thermal refining step in view of cost- and labor-saving and problems such as distortion and misalignment caused by thermal refining. Unfortunately, the fatigue limit of a forging of a steel composition produced by forging followed by nitriding without thermal refining (hereinafter referred to as a non-heat treated, nitrided forging) is lower than that of a conventional forging of the same steel composition produced by forging and subsequent thermal refining followed by nitriding (hereinafter referred to as a heat-treated, nitrided forging).

The forging undergoes some thermal distortion during nitriding. Therefore, subsequent to the nitriding step, the distortion caused by nitriding is eliminated by bending correction or straightening, i.e., by statically applying a bending load to the nitrided forging.

The term "bending toughness" of a forging used herein refers to the maximum strain that can be eliminated by such bending correction, i.e., the limiting strain which can be eliminated from the forging without cracking when the forging is subjected to bending correction after nitriding. The greater the limiting strain of the forging, the better the bending toughness thereof. The limiting strain is hereinafter referred to as "bend-correctable strain" for simplicity.

A non-heat treated, nitrided forging, however, is not satisfactory with respect to its bend-correctable strain, i.e., the limiting strain which can be eliminated from the nitrided forging without cracking. Thus, the bend-correctable strain of a non-heat treated, nitrided forging is lower than that of a heat-treated, nitrided forging.

Hot forging is performed by initially heating a steel billet or dummy to a high temperature which is normally above 1100° C., and after being forged at high temperatures, the forged steel is allowed to cool. During such a hot forging process, the austenitic grains in the steel grow to a coarser grain size so that the steel as forged has an internal structure comprising coarse austenitic grains and ferritic phases precipitated in the form of a net along the boundaries of the coarse austenitic grains in a pearlitic matrix. In non-heat treated, nitrided forgings, a forged steel having such an as-forged internal structure is directly subjected to nitriding without heat treatment for refining the internal structure, and this is thought to cause the above-described inferior properties of the non-heat treated, nitrided forgings compared to heat-treated, nitrided forgings.

Under these circumstances, there is a need to develop a steel capable of producing non-heat treated, nitrided forgings having a high fatigue limit and a high bend-correctable strain.

Steels having a high fatigue limit as-forged without thermal refining and subsequent nitriding have been developed as described, for example, in Japanese Patent Application Laid-Open (Kokai) Nos. 4-193931 (1992) and 64-68424 (1989). However, these steels contains a relatively large amount of vanadium (V) which is intentionally added in order to improve the fatigue limit. Since vanadium is a nitride precipitate-forming element, if these steels which have been developed for non-heat treated, non-nitrided forgings are subjected to nitriding with or without heat treatment, the resulting nitrided forgings will suffer from a low bend-correctable strain.

SUMMARY OF THE INVENTION

It is an object of the present invention to provide non-heat treated, nitrided forgings having a high fatigue limit and a high bend-correctable strain after nitriding without heat refining treatment as well as a lower fluctuation in the amount of distortion caused during nitriding compared to conventional heat-treated, nitrided hot forgings, and a steel suitable for such non-heat treated, nitrided forgings.

The addition of vanadium is effective for improving the fatigue limit of a steel. However, when vanadium is added to a steel for non-heat treated, nitrided forgings, it excessively hardens the surface of the forgings during nitriding to cause the resulting non-heat treated, nitrided forgings to have a significantly diminished bend-correctable strain.

It has been found that the presence of from 0.01% to 0.02% of nitrogen (N) in a steel with limitations on its Cr content of 0.30% or less and V content as an impurity of 0.02% or less has the effects of (1) increasing the depth (thickness) of the surface nitrided layer (which includes an upper compound layer and a lower diffusion layer as described below) formed during nitriding of a non-heat treated forging, (2) decreasing the maximum hardness of the diffusion layer, and (3) increasing the fatigue limit and bend-correctable strain of the non-heat treated, nitrided forging as a synergistic effect of (1) and (2).

Thus, the following steel composition is suitable for non-heat treated, nitrided forgings since it provides non-heat treated, nitrided forgings which possess a good fatigue limit and bend-correctable strain comparable to those of conventional heat-treated, nitrided forgings, and which have a reduced fluctuation in the amount of thermal distortion during nitriding compared to conventional heat-treated, nitrided forgings.

According to one aspect, the present invention provides a forgeable steel capable of being nitrided following forging without heat treatment, wherein the steel has a composition consisting essentially, on a weight basis, of:

C: 0.30–0.60%,

Mn: 0.20–2.00%,

S: less than 0.04%,

Al: less than 0.01%,

Si: 0.05–1.50%,

P: less than 0.02%

Cr: not greater than 0.30%

N: 0.01–0.02%, and a balance of Fe and incidental impurities in which the content of V as an impurity is 0.02% or less.

According to another aspect, the present invention provides a forgeable steel capable of being nitrided following forging without heat treatment, wherein the steel has a composition consisting essentially, on a weight basis, of:

C: 0.30–0.60%,

Mn: 0.20–2.00%,

Al: less than 0.01%,

Si: 0.05–1.50%,

Cr: not greater than 0.30%,

N: 0.01–0.02%, at least one element selected from P: 0.02–0.07%, S: 0.04–0.10%, Ca: 0.0003–0.003%, and Pb: 0.01–0.20%, and a balance of Fe and incidental impurities in which the content of V as an impurity is 0.02% or less.

The present invention also provides a non-heat treated, nitrided forging having either of the above-described steel compositions. The forging has a surface nitrided layer formed by nitriding without heat treatment after forging.

DETAILED DESCRIPTION OF THE INVENTION

Figure 1:
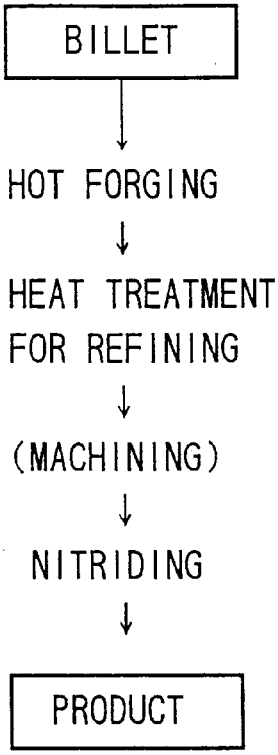
FIG. 1(*a*) illustrates a conventional process for producing heat-treated, nitrided forgings, and FIG. 1(*b*) illustrates a process for producing non-heat treated, nitrided forgings employed in the present invention.
Figure 1:
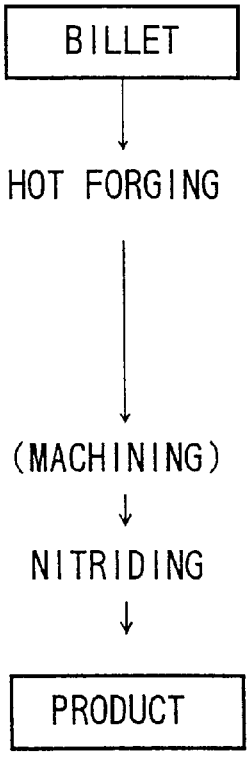

Referring to FIG. 1(*b*), the steel according to the present invention is used as a material for non-heat treated, nitrided forgings produced by hot forging followed by nitriding without heat treatment for refining the hot-forged structure.

Prior to hot forging, the steel material to be forged (billet or roughly-shaped dummy) is heated to a high temperature, which is usually 1100° C. or above, and immediately subjected to forging to give a desired shape. The hot forging may be performed in a conventional manner, e.g., by drawing, extrusion, roll forging, ring rolling, or die forging such as hammer (drop) forging, stamp forging, swage forging, upset forging, or press forging. The particular forging technique may be selected depending on the desired shape, and a combination of two or more techniques may be employed.

After the steel is provided with the desired shape by hot forging, the forging is then subjected to nitriding to form a hardened, surface-nitrided layer with no heat treatment for refining, although machining or a similar form of mechanical working may be applied to the forging prior to nitriding, if necessary, in order to give a finished shape, as shown in FIG. 1(*b*).

The term "heat treatment" used herein indicates a thermal procedure such as quenching-and-tempering, normalizing, or normalizing-and-tempering that has commonly been performed following hot forging in order to provide the forged product with an improved fatigue limit in the production of the conventional heat-treated, nitrided forgings.

The nitriding may also be performed in a conventional manner, such as by gas nitriding, gas soft-nitriding, tufftriding (molten salt soft-nitriding), or ion nitriding. Of these, soft-nitriding including gas soft-nitriding and tufftriding is preferred.

The resulting nitrided layer formed on the surface of the non-heat treated, nitrided forgings of the steel according to the present invention during nitriding is comprised of an outermost (upper) compound layer normally having a thickness of from about 10 to about 20 $\mu$m and an underlying (lower) diffusion layer having a thickness of about 0.05 to 1.0 mm. The compound layer is essential for a nitrided steel in order to provide it with improved resistance to galling or seizure. The underlying diffusion layer is important since it significantly influences the fatigue strength and bending toughness (bend-correctable strain) of the steel.

When various steels are nitrided under identical conditions, the maximum hardness and the depth of the surface nitrided layer formed by nitriding vary depending on the steel composition, thereby varying the fatigue strength and bending properties of the resulting nitrided steels, since both the bending and fatigue behaviors of the nitrided steels are influenced by the properties of the nitrided layer and the bulk (where no nitrogen diffusion caused by nitriding is observed) and by the depth of the nitrided layer.

The depth of a nitrided layer is measured in terms of the practical nitrided layer depth, which is the depth at which the Vickers hardness reaches 50 higher than that of the bulk of the steel.

The non-heat treated, nitrided forgings produced by the steel according to the present invention are characterized in that they have a practical nitrided layer depth which is greater than that of conventional heat-treated, nitrided forgings. The greater practical nitrided layer depth, which is attributable to an increased thickness of the diffusion layer in the nitrided layer, serves to alleviate a residual tensile stress imposed at a crack initiation site even when a stress is applied to the inside of the forged product in use, thereby improving the fatigue limit.

The steel composition is determined as described above in accordance with the present invention for the following reasons. In the following description, all percents are by weight unless otherwise indicated.

Carbon (C):

Carbon is an essential element for attaining a sufficient tensile strength, and the carbon content should be at least 0.30% for this purpose. A carbon content in excess of 0.60% decreases the bend-correctable strain and deteriorates the machinability. Therefore, the carbon content is from 0.30% to 0.60% and preferably 0.30–0.43%.

Silicon (Si):

Silicon is an element necessary for steel making as a deoxidizer, and the silicon content should be at least 0.05% for this purpose. Addition of Si in an excessive amount decreases the bend-correctable strain and accelerates surface decarburization during forging. Therefore, the silicon content is from 0.05% to 1.50%, preferably 0.1–1.0%, and more preferably 0.2–0.5%.

Manganese (Mn):

Manganese should be added in an amount of at least 0.20% for deoxidation during steel making and for suppressing decarburization during forging. Addition of Mn in an excessive amount causes the formation of bainite, which serves to improve the hardenability of the steel, but deteriorates the machinability and decreases the bend-correctable strain. The Mn content is therefore from 0.20% to 2.00%, preferably from 0.4–1.6%, and more preferably 0.8–1.4%.

Phosphorus (P):

Phosphorus is unavoidably incorporated in a steel and serves to decrease its toughness. Therefore, the P content is normally decreased to less than 0.02%. However, addition of phosphorus in an appropriate amount has an effect of improving the machinability, although the impact value is sacrificed. Therefore, when machinability is more important than toughness, phosphorus can be present in the steel intentionally. For this purpose, a phosphorus content of at least 0.02% is necessary, but addition of phosphorus in excess of 0.07% causes a significant decrease in toughness.

Thus, most broadly, a phosphorus content up to 0.07% is acceptable in the steel according to the present invention. The P content is between 0.02% and 0.07% and preferably 0.03% and 0.05% when machinability is preferentially improved, or less than 0.02% when further improvement in toughness is desired.

Sulfur (S):

Sulfur, which is also unavoidably incorporated in a steel, decreases the toughness and fatigue strength of the steel. Therefore, the sulfur content is normally decreased to less than 0.04%. However, addition of sulfur in an appropriate amount has an effect of improving the machinability, although the toughness and fatigue strength are sacrificed. Therefore, when machinability has priority, sulfur can be present in the steel intentionally. For this purpose, a sulfur content of at least 0.04% is necessary, but addition of sulfur in excess of 0.10% causes a significant decrease in toughness and fatigue strength.

Thus, most broadly, a sulfur content up to 0.10% is acceptable in the steel according to the present invention. The S content is between 0.04% and 0.10% and preferably 0.05% and 0.08% when machinability is preferentially improved, or less than 0.04% and preferably 0.03% or less when further improvement in toughness and fatigue strength is desired.

Chromium (Cr):

Chromium is an element serving to improve the wear resistance of a steel, but addition of Cr in an excessive amount causes hard chromium nitride precipitates to be formed during nitriding to such a degree that the bend-correctable strain is significantly decreased. Therefore, the Cr content should be 0.30% or less. The minimum Cr content is an effective amount to improve the wear resistance, and it is usually 0.01%. Preferably, the Cr content is between 0.03% and 0.25% and more preferably between 0.05% and 0.15%.

Aluminum (Al):

Aluminum is an effective deoxidizing element, but addition of Al in an excessive amount is harmful since it promotes the formation of hard Al-containing inclusions. Therefore, the Al content is less than 0.01% and preferably 0.005% or less.

Calcium (Ca):

Calcium may be added since it is effective for improving machinability. In order to attain such an effect, at least 0.0003% of Ca is necessary. However, addition of Ca in excess of 0.003% increases the amount of inclusions, thereby adversely affecting the hot workability and fatigue limit. Therefore, when added, the Ca content is from 0.0003% to 0.003% and preferably 0.0005–0.0025%, Lead (Pb):

Lead may also be added since it is greatly effective for improving machinability. Therefore, when good machinability is required for the forging to enable machining after forging, it is desirable to add Pb. In order to attain such an effect, at least 0.01% of Pb is necessary. However, addition of Pb in excess of 0.20% increases the amount of inclusions, thereby adversely affecting the hot workability and fatigue limit. Therefore, when added, the Pb content is from 0.01% to 0.20% and preferably 0.05–0.15%.

Nitrogen (N):

Nitrogen is an element which is effective for the improvement in both fatigue limit and bend-correctable strain. In order to attain such an effect, at least 0.01% of nitrogen is necessary. However, addition of nitrogen in an amount exceeding 0.02% is difficult in normal steel making operation and also results in the saturation of the effect. Therefore, nitrogen is present in an amount of from 0.01% to 0.02%, and preferably 0.013% to 0.020%.

Vanadium (V):

Vanadium is an element which is effective for improving the fatigue limit, but addition of vanadium in an amount as low as 0.03% causes a significant decrease in bend-correctable strain due to the formation of hard precipitates during nitriding. Therefore, vanadium should not be added intentionally in accordance with the present invention, and the vanadium content present as an impurity should be restricted to 0.02% or less and preferably 0.01% or less.

The mechanism by which the steel according to the present invention exhibits an improved fatigue limit and bend-correctable strain are considered to be as follows.

1) Fatigue limit

The nitrogen which has been dissolved in a large amount as a solid solution in the steel before nitriding has a solid-solution strengthening effect and serves to strengthen the crack initiation site (in the vicinity of the interface between the bulk and the surface nitrided layer) generated in a fatigue test. Moreover, after nitriding, the hardness distribution of the surface nitrided layer formed by nitriding (which corresponds to the distribution of dissolved nitrogen) has a relatively gentle gradation due to the large amount of nitrogen which has been dissolved within the steel before nitriding, thereby decreasing the residual strain in the vicinity of the crack initiation site in the fatigue test. As a result, the steel has a high fatigue limit.

In contrast, in a conventional steel for nitrided forgings, residual tensile stress is imposed in the vicinity of the crack initiation site and adversely affects the fatigue limit.

2) Bend-correctable strain

Generally, as the surface hardness (maximum hardness) of a forging increases, it is more susceptible to cracking. The surface hardness is significantly affected by the precipitates formed during nitriding rather than by the amount of dissolved nitrogen. As described previously, vanadium forms precipitates during nitriding to increase the surface hardness, thereby decreasing the bend-correctable strain. However, since vanadium is not added to the steel according to the present invention, the steel has an improved bending toughness, particularly in the diffusion layer of the nitrided layer. Furthermore, the presence of from 0.01% to 0.02% N in the steel serves to refine former austenitic grains, i.e., austenitic grains which were present in the steel before cooling and which have been transformed into ferrite by cooling, and this also contributes to the increased bend-correctable strain.

The following examples are presented to further illustrate the present invention. These examples are to be considered in all respects as illustrative and not restrictive.

EXAMPLE

Preliminary Test

In order to examine the effects of various elements on the fatigue limit and bend-correctable strain of non-heat treated, nitrided forgings, a preliminary test was performed on sixteen steels which had compositions based on JIS S48C steel and were prepared by melting with various amounts of the elements shown in Table 1 and cast into cylindrical ingots having a diameter of 100 mm.

The ingots were heated to 1150° C. and hot-forged so as to be drawn into round bars having a diameter of 30 mm. The forged bars were then machined to give test specimens for the Ono-type rotating bending fatigue test, which specimens are round bars with a diameter of 12 mm and a length of 105 mm having a central neck portion with a diameter of 8 mm, and test specimens for a static three-point bending test, which specimens are round bars with a diameter of 20 mm and a length of 400 mm having no neck portion. Each test specimen was subjected, without heat treatment for refining, to gas soft-nitriding by maintaining it for 3 hours in a mixed gas atmosphere of $N_2$ and $NH_3$ at a ratio of 1:1 at 570° C. followed by oil quenching.

For comparison, a forged steel bar of Steel No. X1, which corresponds to JIS S48C, was separately subjected to normalizing, a kind of heat treatment for refining, by maintaining it for 15 minutes at 860° C. followed by air cooling, before it was nitrided in the same manner as described above. The fatigue limit and bend-correctable strain of the resulting heat-treated forging of Steel No. X1 determined after the soft-nitriding treatment were regarded as target values for the non-heat treated, nitrided forgings of the steels according to the present invention.

TABLE 1

| Test Steel | Chemical Composition (wt %) | | | | | |
|---|---|---|---|---|---|---|
| No. | C | Si | Mn | Cr | N | V |
| X1 | 0.48 | 0.24 | 0.59 | — | 0.001 | — |
| X2 | 0.35* | 0.25 | 0.60 | — | 0.002 | — |
| X3 | 0.55* | 0.25 | 0.60 | 0.01 | 0.002 | — |
| X4 | 0.48 | 0.98* | 0.59 | — | 0.001 | — |
| X5 | 0.49 | 1.49* | 0.61 | — | 0.001 | — |
| X6 | 0.48 | 0.24 | 1.02* | 0.02 | 0.002 | — |
| X7 | 0.50 | 0.26 | 1.98* | — | 0.001 | — |
| X8 | 0.51 | 0.25 | 0.60 | 0.10* | 0.002 | — |
| X9 | 0.49 | 0.27 | 0.60 | 0.28* | 0.002 | — |
| X10 | 0.49 | 0.24 | 0.61 | 0.39* | 0.001 | — |
| X11 | 0.49 | 0.24 | 0.61 | — | 0.005* | — |
| X12 | 0.48 | 0.25 | 0.59 | — | 0.011* | — |
| X13 | 0.50 | 0.26 | 0.60 | — | 0.015* | — |
| X14 | 0.48 | 0.25 | 0.60 | 0.01 | 0.019* | — |
| X15 | 0.49 | 0.24 | 0.59 | 0.01 | 0.001 | 0.03* |
| X16 | 0.48 | 0.26 | 0.59 | — | 0.001 | 0.11* |

P: 0.02–0.04%, S: 0.04–0.06%, Al: 0.003–0.006%, Ca: 0.0005–0.0015%.
*indicates the content intentionally changed.

The rotating bending fatigue test was performed in air at room temperature at a cycle rate of 50 Hz (=3,000 cycles/min). The stress amplitude when the number of cycles to failure reached $10^7$ was taken as the fatigue limit.

The static three-point bending test was performed in air at room temperature by applying a bending load at the strain rate exerted at the position where the generated strain is the largest (around 100 μm/sec). Whenever the amount of strain determined reached 500 μm, the test was interrupted and the test specimen was examined by magnetic particle testing in order to determine whether cracking had occurred. The largest strain determined immediately before cracking was detected by the magnetic particle testing was taken as the bend-correctable strain.

Figure 2:
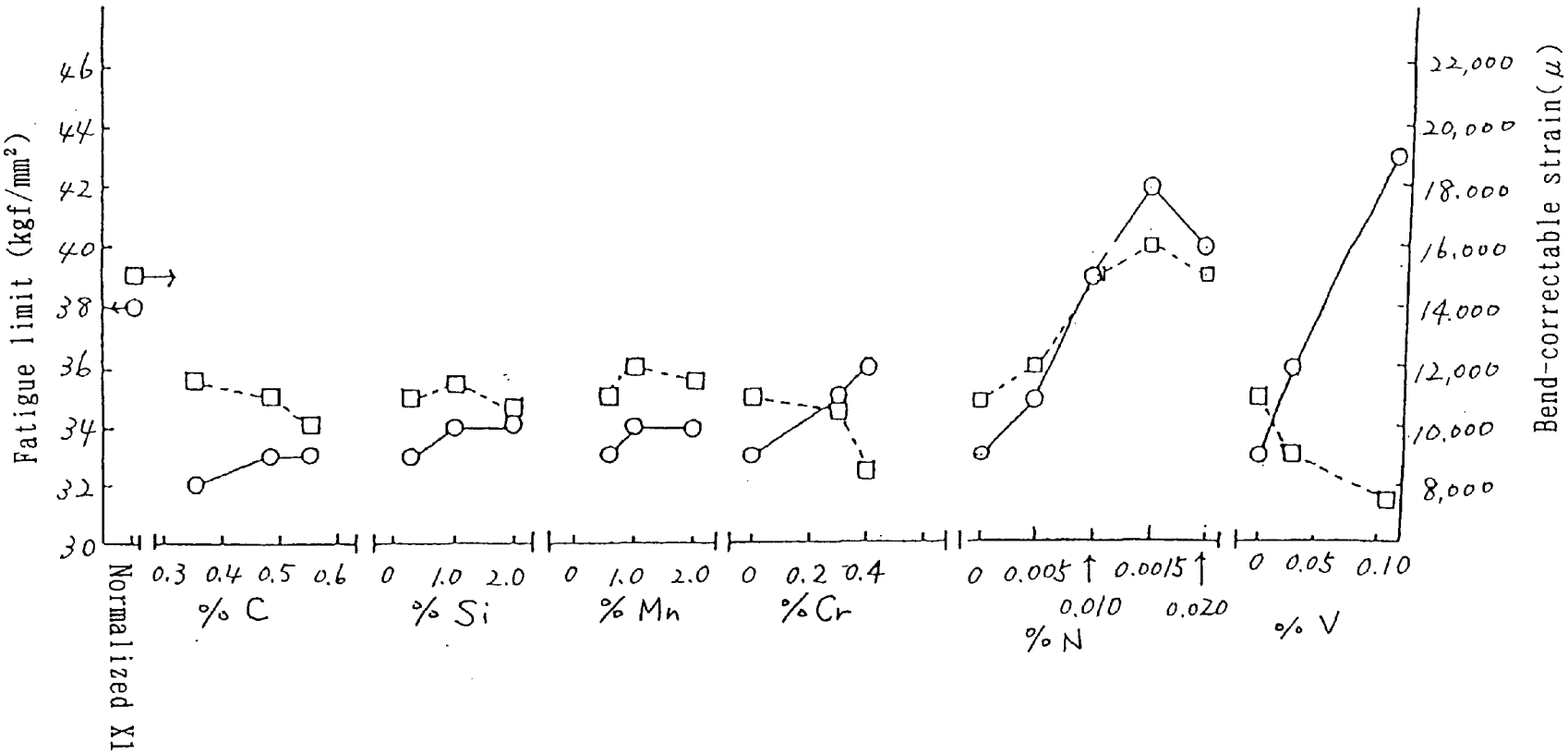
FIG. 2 is a graph showing the effects of various elements in steel compositions on fatigue limit and bend-correctable strain.

FIG. 2 shows the effects of the contents of various elements on fatigue limit (○ and solid lines) and bend-correctable strain (□ and dashed lines). As can be seen from this figure, nitrogen (N) is effective for the improvement in both fatigue limit and bend-correctable strain, and at least 0.01% N should be added in order to improve these properties to the targeted values, i.e., equal to or higher than the corresponding values for fatigue limit (38 kgf/mm$^2$) and bend-correctable strain (15,000 μm) obtained with the normalized (heat-treated) test specimen of S48C (Steel No. X1) after gas soft-nitriding. The addition of Cr and V is effective for improving the fatigue limit but decreases the bend-correctable strain. The effects of C, Si, and Mn are relatively small.

Figure 3:
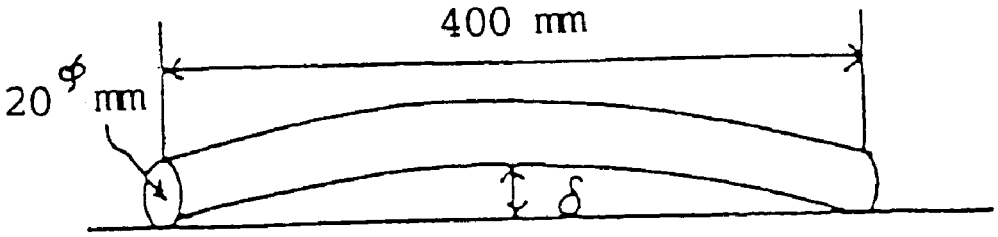
FIG. 3 is a schematic illustration showing a method for measuring the amount of thermal distortion of a forging.

Separately, each of the above steels to be tested was evaluated for thermal distortion after the gas soft-nitriding using test specimens having the same round bar shape (20 mm diameter×400 mm long) as those used in the static three-point bending test. The amount of thermal distortion (δ) was measured in the manner shown in FIG. 3 after the nitriding treatment. For each steel to be tested, ten nitrided samples (test specimens) were selected at random to measure the thermal distortion caused by nitriding, and a standard deviation of the measured values was calculated. In this test, the standard deviation of thermal distortion was within the range of 10–20 μm for all the non-heat treated, nitrided steels X1 to X16 except for X9 (31 μm) and X10 (35 μm). On the contrary, the standard deviation of thermal distortion for the heat-treated steel X1 (control) was 46 μm, indicating that the fluctuation in thermal distortion of heat-treated, nitrided forgings was greater than that of non-heat treated, nitrided forgings.

Example 1

Steels (50 kg) having the chemical compositions shown in Table 2 were prepared by melting in air and cast into cylindrical ingots having a diameter of 100 mm. The ingots were heated to 1150° C. and then hot-forged so as to be drawn into round bars having a diameter of 30 mm while the steel temperature was kept at 900° C. or above. From the forged bars, test specimens for the Ono-type rotating bending fatigue test and for a static three-point bending test, both types of specimens having the same dimensions as described above, were cut out by machining. Each test specimen was subjected, without heat treatment for refining, to gas soft-nitriding by maintaining it for 3 hours in a mixed gas atmosphere of $N_2$ and $NH_3$ at a ratio of 1:1 at 570° C. followed by oil quenching (immersion in oil at 150° C.).

The fatigue limit and bend-correctable strain of the resulting non-heat treated, nitrided forgings were evaluated in the same manner as described above, and the results are also shown in Table 2.

The machinability of each steel to be tested was also evaluated by recording the tool life during machining of the forged bars to form the test specimens. The tool life was compared to that obtained with heat-treated forged bars having the same composition as S48C (Steel No. X1 in Table 1) except that 0.05% of Pb was added. The heat treatment was performed by normalizing in the same conditions as described above for X1 steel. The tool life of the steels to be tested was evaluated as good when it was comparable to that of heat-treated, Pb-containing S48C steel. Good machinability is indicated by the mark O in Table 2.

TABLE 2

| No. | Chemical Composition (wt %) C | Si | Mn | F | S | V | Al | Cr | Ca | N | Pb | Fatigue limit (kgf/mm$^2$) | Bend-Correctable strain ($\mu$) | Machinability |
|---|---|---|---|---|---|---|---|---|---|---|---|---|---|---|
| 1 | 0.48 | 0.25 | 1.21 | 0.018 | 0.088 | <0.01 | 0.004 | 0.15 | — | 0.013 | — | 40 | 16000 | ○ |
| 2 | 0.43 | 1.48 | 0.60 | 0.066 | 0.035 | <0.01 | 0.005 | 0.26 | — | 0.014 | 0.12 | 38 | 15500 | ○ |
| 3 | 0.48 | 1.21 | 1.19 | 0.015 | 0.031 | <0.01 | 0.003 | 0.02 | — | 0.018 | — | 42 | 16500 | X |
| 4 | 0.35 | 0.33 | 1.40 | 0.018 | 0.022 | <0.01 | 0.002 | 0.02 | — | 0.016 | 0.05 | 41 | 17000 | ○ |
| 5 | 0.36 | 0.98 | 1.45 | 0.015 | 0.090 | <0.01 | 0.005 | 0.09 | 0.0024 | 0.017 | — | 39 | 15500 | ○ |
| 6 | 0.38 | 0.25 | 0.60 | 0.017 | 0.025 | <0.01 | 0.003 | 0.01 | — | 0.017 | — | 42 | 16500 | X |
| 7 | 0.48 | 0.08 | 0.40 | 0.018 | 0.028 | <0.01 | 0.005 | 0.11 | — | 0.019 | — | 40 | 16000 | X |
| 8 | 0.48 | 0.60 | 1.32 | 0.018 | 0.018 | <0.01 | 0.003 | 0.01 | — | 0.019 | — | 42 | 16500 | X |
| 9 | 0.55 | 0.40 | 0.70 | 0.039 | 0.006 | <0.01 | 0.005 | 0.10 | 0.0017 | 0.011 | — | 39 | 15500 | ○ |
| 10 | 0.48 | 0.59 | 1.29 | 0.041 | 0.051 | <0.01 | 0.005 | 0.02 | 0.0005 | 0.019 | 0.18 | 41 | 16000 | ○ |
| 11 | 0.27* | 0.24 | 0.58 | 0.019 | 0.025 | <0.01 | 0.005 | 0.04 | — | 0.012 | — | 37** | 17000 | X |
| 12 | 0.62* | 0.25 | 0.58 | 0.018 | 0.035 | <0.01 | 0.005 | 0.02 | — | 0.011 | — | 38 | 14000** | X |
| 13 | 0.49 | 1.69* | 0.98 | 0.042 | 0.051 | <0.01 | 0.004 | 0.03 | 0.0006 | 0.015 | — | 41 | 14500** | ○ |
| 14 | 0.51 | 0.26 | 2.30* | 0.017 | 0.048 | <0.01 | 0.005 | 0.19 | — | 0.016 | — | 37** | 13000** | ○ |
| 15 | 0.53 | 1.39 | 0.54 | 0.079* | 0.050 | <0.01 | 0.003 | 0.02 | — | 0.017 | — | 40 | 13500** | ○ |
| 16 | 0.49 | 0.50 | 1.01 | 0.015 | 0.115* | <0.01 | 0.004 | 0.15 | 0.0022 | 0.015 | — | 32** | 15000 | ○ |
| 17 | 0.39 | 0.24 | 1.49 | 0.013 | 0.051 | 0.02* | 0.005 | 0.03 | 0.0008 | 0.017 | — | 46 | 8500** | ○ |
| 18 | 0.47 | 0.57 | 0.58 | 0.019 | 0.037 | <0.01 | 0.012* | 0.02 | — | 0.013 | — | 38** | 13000** | X |
| 19 | 0.48 | 1.44 | 1.23 | 0.019 | 0.052 | <0.01 | 0.005 | 0.35* | — | 0.014 | 0.15 | 39 | 9500** | ○ |
| 20 | 0.45 | 0.24 | 1.88 | 0.059 | 0.048 | <0.01 | 0.005 | 0.01 | 0.0037* | 0.013 | — | 36** | 12000** | ○ |
| 21 | 0.47 | 0.26 | 1.83 | 0.048 | 0.051 | <0.01 | 0.004 | 0.02 | 0.0006 | 0.007* | — | 37** | 14500** | ○ |
| 22 | 0.49 | 0.27 | 1.89 | 0.017 | 0.028 | <0.01 | 0.005 | 0.01 | — | 0.003* | — | 33** | 12300** | X |
| 23 | 0.48 | 0.57 | 1.27 | 0.041 | 0.049 | <0.01 | 0.004 | 0.02 | — | 0.017 | 0.24* | 37** | 15000 | ○ |
| 24 | 0.51 | 0.18 | 0.81 | 0.017 | 0.015 | 0.00* | 0.010* | 0.03 | — | 0.005* | — | 39 | 7500** | X |
| 25 | 0.39 | 0.21 | 0.99 | 0.011 | 0.053 | 0.14* | 0.010* | 0.36* | 0.0006 | 0.006* | — | 41 | 6500** | ○ |
| 26 | 0.46 | 0.24 | 0.81 | 0.019 | 0.030 | 0.08* | 0.011* | 0.05 | — | 0.005* | — | 40 | 7000** | X |

(Notes) Nos. 1 to 10 are examples according to this invention, and Nos. 11 to 26 are comparative examples.
*: Content outside the range defined herein (P < 0.02% and S < 0.04% are impurities)
**: values not reaching the target value.

As can be seen from Table, all the steels according to the present invention had values for fatigue limit and bend-correctable strain which were equal to or higher than the target values, i.e., 38 kgf/mm$^2$ for fatigue limit and 15,000 $\mu$m for bend-correctable strain, obtained with the normalized (heat-treated) test specimen of S48C steel (Steel No. X1) after gas soft-nitriding. In contrast, in the comparative steels, either one or both of the fatigue limit and the bend-correctable strain did not reach the target value.

It will be appreciated by those skilled in the art that numerous variations and modifications may be made to the invention as described above with respect to specific embodiments without departing from the spirit or scope of the invention as broadly described.

What is claimed is:

1. A forged steel part which has a surface nitrided layer formed by nitriding following forging without heat treatment and having a composition consisting essentially, on a weight basis, of:

C: 0.30–0.60%,

Mn: 0.20–2.00%,

S: less than 0.04%,

Al: less than 0.01%,

Si: 0.05–1.50%,

P: less than 0.02%,

Cr: an amount effective to improve wear resistance but not greater than 0.30%,

N: 0.01–0.02%, and a balance of Fe and incidental impurities in which the content of V as an impurity is 0.02% or less.

2. A forged steel part which has a surface nitride layer formed by nitriding following forging without heat treatment and having a composition consisting essentially, on a weight basis, of:

C: 0.30–0.60%,

Mn: 0.20–2.00%,

Al: less than 0.01%,

Si: 0.05–1.50%,

Cr: an amount effective to improve wear resistance but not greater than 0.30%,

N: 0.01–0.02%, at least one element selected from P: 0.02–0.07%, S: 0.04–0.10%, Ca: 0.0003–0.003%, and Pb: 0.01–0.20%, and a balance of Fe and incidental impurities in which the content of V as an impurity is 0.02% or less.

3. The forged steel part as set forth in claim 1, wherein the content of V is 0.01% or less.

4. The forged steel part as set forth in claim 2, wherein the content of V is 0.01% or less.

5. A forged steel part having a composition consisting essentially, on a weight basis, of:

C: 0.30–0.60%,

Mn: 0.20–2.00%,

S: less than 0.04%,

Al: less than 0.01%,

Si: 0.05–1.50%,

P: less than 0.02%,

Cr: not greater than 0.30%,

N: 0.01–0.02%, and a balance of Fe and incidental impurities in which the content of V as an impurity is less than 0.01%; and the forged steel part having a surface nitrided layer formed by nitriding following forging without heat treatment.

6. A forged steel part having a composition consisting essentially, on a weight basis, of:

C: 0.30–0.60%,

Mn: 0.20–2.00%,

Al: less than 0.01%,

Si: 0.05–1.50%,

Cr: not greater than 0.30%,

N: 0.01–0.02%, at least one element selected from P: 0.02–0.07%, S: 0.04–0.10%, Ca: 0.0003–0.003%, and Pb: 0.01–0.20%, and a balance of Fe and incidental impurities in which the content of V as an impurity is less than 0.01%; and the forged steel part having a surface nitrided layer formed by nitriding following forging without heat treatment.

7. A process for producing a forged steel part, comprising subjecting a steel to hot forging and then to nitriding without heat treatment after forging, the steel having a composition consisting essentially, on a weight basis, of:

C: 0.30–0.60%

Mn: 0.20–2.00%

S: less than 0.04%

Al: less than 0.01%

Si: 0.05–1.50%

P: less than 0.02%

Cr: not greater than 0.30%

N: 0.01–0.02%, and a balance of Fe and incidental impurities in which the content of V as an impurity is less than 0.01%.

8. A process for producing a forged steel part, comprising subjecting a steel to hot forging and then to nitriding without heat treatment after forging, the steel having a composition consisting essentially, on a weight basis, of:

C: 0.30–0.60%

Mn: 0.20–2.00%

Al: less than 0.01%,

Si: 0.05–1.50%,

Cr: not greater than 0.30%,

N: 0.01–0.02%, at least one element selected from P: 0.02–0.07%, S: 0.04–0.10%, Ca: 0.0003–0.003%, and Pb: 0.01–0.20%, and a balance of Fe and incidental impurities in which the content of V as an impurity is less than 0.01%.

9. The process as set forth in claim 7 wherein the nitriding is performed by soft-nitriding selected from gas soft-nitriding and tufftriding.

10. The process as set forth in claim 8 wherein the nitriding is performed by soft-nitriding selected from gas soft-nitriding and tufftriding.

11. The forged steel part as set forth in claim 1, wherein the content of Cr is at least 0.01%.

12. The forged steel part as set forth in claim 1, wherein the content of Cr is 0.05 to 0.15%.

13. The forged steel part as set forth in claim 2, wherein the content of Cr is at least 0.01%.

14. The forged steel part as set forth in claim 2, wherein the content of Cr is 0.05 to 0.15%.

15. The forged steel part as set forth in claim 1, wherein the forged steel part has a surface nitrided layer comprised of an upper compound layer and a lower diffusion layer.

16. The forged steel part as set forth in claim 15, wherein the nitrided layer is effective to improve a fatigue limit of the steel part as a result of increased nitrogen dissolved within the steel before nitriding.

17. The forged steel part as set forth in claim 15, wherein the nitrided layer improves the fatigue limit as a result of a small enough gradation in a hardness distribution in the nitrided layer to decrease residual strain at crack initiation sites.

18. The forged steel part as set forth in claim 2, wherein the forged steel part has a surface nitrided layer comprised of an upper compound layer and a lower diffusion layer.

19. The forged steel part as set forth in claim 18, wherein the nitrided layer is effective to improve a fatigue limit of the steel part as a result of increased nitrogen dissolved within the steel before nitriding.

20. The forged steel part as set forth in claim 18, wherein the nitrided layer improves the fatigue limit as a result of a small enough gradation in a hardness distribution in the nitrided layer to decrease residual strain at crack initiation sites.

* * * * *